US006140588A

United States Patent [19]

Valdemarsson et al.

[11] Patent Number: 6,140,588

[45] **Date of Patent: *Oct. 31, 2000**

[54] ARRANGEMENT AT A CONDUCTOR ON HIGH VOLTAGE POTENTIAL

[75] Inventors: Stefan Valdemarsson; Anders Björklund, both of Västerås; Mats Leijon, Surahammar; Tommy Holmgren, Ludvika; Dan Windmar, Vittinge; Urban Åström, Saxdalen, all of Sweden

[73] Assignee: Asea Brown Boveri AB, Vasteras, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/896,496

[22] Filed: Jul. 18, 1997

[51] Int. Cl.[7] ..... H01B 5/14

[52] U.S. Cl. ..... 174/127; 336/55; 174/5 R

[58] Field of Search ..... 174/2, 5 R, 55 G, 174/55 B, 127; 323/306, 331; 336/171, 172, 184, 179, 331, 70

[56] References Cited

U.S. PATENT DOCUMENTS

| | | | |
|---|---|---|---|
| 2,279,028 | 4/1942 | Weed | 336/70 |
| 3,678,428 | 7/1972 | Morris et al. | 336/84 |
| 4,153,891 | 5/1979 | NcNutt | 336/70 |
| 4,318,066 | 3/1982 | Degeneff et al. | 336/70 |
| 4,855,873 | 8/1989 | Bhargava et al. | 361/424 |
| 5,558,915 | 9/1996 | Herbst et al. | 428/76 |
| 5,900,795 | 5/1999 | Holmgren et al. | 336/55 |

*Primary Examiner*—Kristine Kincaid
*Assistant Examiner*—Adolfo Nino
*Attorney, Agent, or Firm*—Dykema Gossett, PLLC

[57] ABSTRACT

An arrangement with a conductor (15) intended to be on a high potential and a part (12) connected to ground and separated therefrom by at least a voltage receiving air gap (16, 17), comprising an insulating envelope (18) surrounding said conductor and at least a first member (9) of electrical insulating material arranged to screen off said ground part from said conductor. Said air gap is dimensioned to get such a high electrical field strength by possible sudden, strong voltage raises of said conductor, that air molecules in said air gap will be ionized. Said insulating envelope (18) and the insulating member (9) have surfaces arranged to receive electrical charges generated through said ionizing for creating a voltage over their thicknesses and decreasing the voltage drop in the air gap between the conductor (15) and the ground part (12).

4 Claims, 3 Drawing Sheets

13
12
9
6
7
5
10
8
11

ARRANGEMENT AT A CONDUCTOR ON HIGH VOLTAGE POTENTIAL

FIELD OF THE INVENTION AND PRIOR ART

The present invention relates to an arrangement comprising an electrical conductor intended to be on a high voltage potential and a part connected to ground and separated therefrom by at least a voltage receiving air gap.

The invention finds applications on all types of electrical equipment where a conductor is on a high potential and separated from a part connected with ground by means of an air gap, but from now on the purpose of the inventive problem will be illustrated by the special case of a so-called tunable harmonic filter. The invention should however by no means be regarded to be limited to this special case.

Such a tunable harmonic filter is formed by a capacitor and a controllable inductor, the controllable inductor being connected to the high voltage net by an outer coil winding and via the capacitor in connection with a high voltage station for converting direct voltage to alternating voltage and vice versa, the controllable inductor usually being connected to the alternating voltage side. By such a controllable inductor the permeability of its core and thereby the inductance will be adjusted by means of cross-magneticisation generated by control windings passing axially inside the core, whereby the inductance of the inductor may be adapted to the specific frequency of an overtone generated in the high voltage net and intended to be faded out, for effective fade-out thereof causing small energy losses in the inductor. An inductor of this type is previously known from for example EP-C-0 010 502, SU-A-678 542 and WO 94/11891.

By these previously known controllable inductors, the coil conductor is thus on a high voltage potential, while the control winding itself functions as a ground part or being surrounded of a part connected to ground. The air gap between said ground part and said coil conductor receives the complete voltage drop between the high voltage potential and the ground part, and it is necessary that this air gap is so large that the electrical field strength thereof by possible strong voltage raises, so-called peak voltages will not get so high that electrical flash-overs will be caused from the conductor to the ground part, which would damage the inductor with a serious risk for causing a fire. Such peak voltages are initiated from for example very short atmospheric overvoltages, i.e. lightning strokes. These peak voltages are usually several times higher than the normal operative voltage of the net, and it is very important that the inductor endures these high peak voltages. As inductors of this type are large and expensive constructions it is a big disadvantage that the air gaps of the previously known inductors must be made so large to manage the demands of the peak voltages, and they become much more expensive than if their dimensions would have been smaller.

SUMMARY OF THE INVENTION

The object of the present invention is to provide an arrangement of the type defined in the introduction, which causes a reduction to a large extent of the above discussed problems.

This object is achieved according to the invention by way of said arrangement also comprising an insulating envelope surrounding said conductor and a first member of electrical insulating material arranged to screen off said ground part from said conductor, that said air gap is dimensioned to get such a high electrical field strength by possible sudden, strong voltage raises of said conductor, that air molecules in said air gap will be ionized, and that said insulating envelope and the insulating member have surfaces arranged to receive electrical charges generated through said ionizing for creating a voltage over their thicknesses and decreasing the voltage drop in the air gap between said conductor and said ground part.

Thanks to this way of allowing the air to be ionized, i.e. putting it under so large stresses, i.e. high electrical field strength, at appearance of peak voltages that it will be ionized and that said insulating envelope and said insulating member are used as barrier members carrying a part of the voltage drop, said voltage drop in the air gap between the conductor and the ground part will be decreased to a considerably lower level. In this way it will thus be possible to make the air gap considerably smaller without by no means form the insulating envelope surrounding the conductor with an unproportional thickness, so that the inductor may be formed more compact and thereby considerably more inexpensive without decreasing its operating capability. In spite of an increased air gap there is thus no risk for devastating flash-overs. As already has been mentioned the corresponding advantages would of course be obtained by utilizing the invention at some other arrangement connected to high voltage, and this solution finds applications in all cases where an electrical conductor being on a high potential is running with such an air gap between itself and the ground, that it is desirable to keep the size of it down.

According to a preferred embodiment of the invention the ground part is arranged closely to the insulating member. Thanks to such relative arrangement of the ground part and the insulating member, they will thus not be separated by any air gap, so that there will be no air therebetween having access to the free charges of the ground part and in this way the risk of flash-overs will be minimized. Besides by coating the conductor and the ground part in a way that takes place by the arrangement of the insulating envelope and the insulating member for screening off the ground part a glow will be obtained at a higher voltage than usually, the electrical part and the ground part being equal with two electrodes. A glow will more exactly be obtained at a sharp limit, causing no glow below this limit and a strongly increasing glow above this limit. This is due to the lack of charge holders (electrons) at the surface of said electrodes as these are coated. By the insulating system according to the invention a high glow limit will thus be achieved.

According to another preferred embodiment of the invention the ground part is arranged on a surface of the insulating member that is turned away from the conductor. In this way there will be obtained a good screen off of the ground part with respect to the air gap between the insulating member and the conductor, in which air gap is now allowed for the air molecules to be ionized at peak voltage and thereby causing generated electrical charges to settle on the surface of the insulating member defining the air gap.

According to another preferred embodiment of the invention said ground part is embedded in the insulating member and surrounded by insulating material of said insulating member. By such an embedding of the ground part the risk for detrimental electrical discharges in the proximity of the ground part will be further reduced—in the case of a controllable inductor just outside its control winding.

According to another preferred embodiment of the invention where said ground part is arranged closely to said insulating member and said ground part is also arranged to end at a distance from that edge region of said insulating member, where the side of said insulating member on which said ground part is arranged ends, for preventing that electrical charges generated by said ionizing and received on an opposite side of said insulating member, will migrate to said edge region and reach said ground part. Thanks to an ending of the ground part at a distance from said edge region it will be possible to increase the accepted level of the voltage created in this way over the insulating member, at which voltage the charges will migrate to the ground plane. If the field strength in the air gap connected to the insulating member will be high enough so many charges will however settle down on the insulating member that their repellent effect on each other will cause a migration of the charges around said edge region to the ground part. Thanks to this embodiment according to the invention the risk for this migration to take place will be eliminated at peak voltages of a specific size by a suitable construction of said arrangement.

According to another preferred embodiment of the invention the arrangement comprises at least one further, second insulating member arranged between said conductor and the first-mentioned, first insulating member is designed to receive electrical charges on surfaces thereof, said charges being generated from said voltage raises as a consequence of the ionizing of the air molecules, for taking a part of the voltage drop between said conductor and said ground part over its thickness. Thanks to the arrangement of a further such insulating member the voltage drop in said air gap may be further decreased, so that it will be possible to make the arrangement more compact without any risk for detrimental flash-overs at appearance of peak voltages.

According to another preferred embodiment of the invention, the arrangement is a controllable inductor with at least a tubular core, a main winding surrounding said core and having said conductor and a control winding passing substantially axially through said core, and that said ground part is arranged radially outside said core and said first insulating member outside said ground part but inside said main winding, and the ground part surrounds the core and formed by strips of electrical conducting material connected to ground and separated by either an insulator or a semiconductor layer therebetween for limiting eddy current losses due to parts of the magneticic flux of the main winding passing through the ground part. By such a cutting in strips of the ground part, the possible paths of the eddy currents obtainable in the ground part will be reduced due to that the magneticic flux generated by the main winding having a component in the direction perpendicular to the plane of the ground part, so that the eddy current losses will be kept down and there will be no requirements of that the ground part must be made of a material with a high resistance.

According to another preferred embodiment of the invention said strips have their length direction directed substantially axially with respect to said core. In this way small eddy current losses will be achieved. This embodiment is especially advantageous in combination with the ground part having a strip extending across the other strips and arranged to ly connect the strips with each other and thereby together to ground. In this way it will namely be possible to arrange a member connected to ground inside the ground part strips and ensure contact between this member and the ground part independent of how the ground part is twisted around its length axis at the mounting thereof in the inductor.

According to another preferred embodiment of the invention the ground part is formed by a conducting colour applied on said first insulating member. In this way it is possible to provide the arrangement with a ground part by very simple means and at the same time ensure a good contact without any air spacings between the ground part and the insulating member.

Further advantages and advantageous characteristics of the invention will be apparent in the following description and other dependent claims.

BRIEF DESCRIPTION OF THE DRAWINGS

With reference to the appended drawings, below follows a description of a preferred embodiment of the invention cited as an example. In the drawings.

DETAILED DESCRIPTION OF PREFERRED EMBODIMENTS OF THE INVENTION

Figure 1:
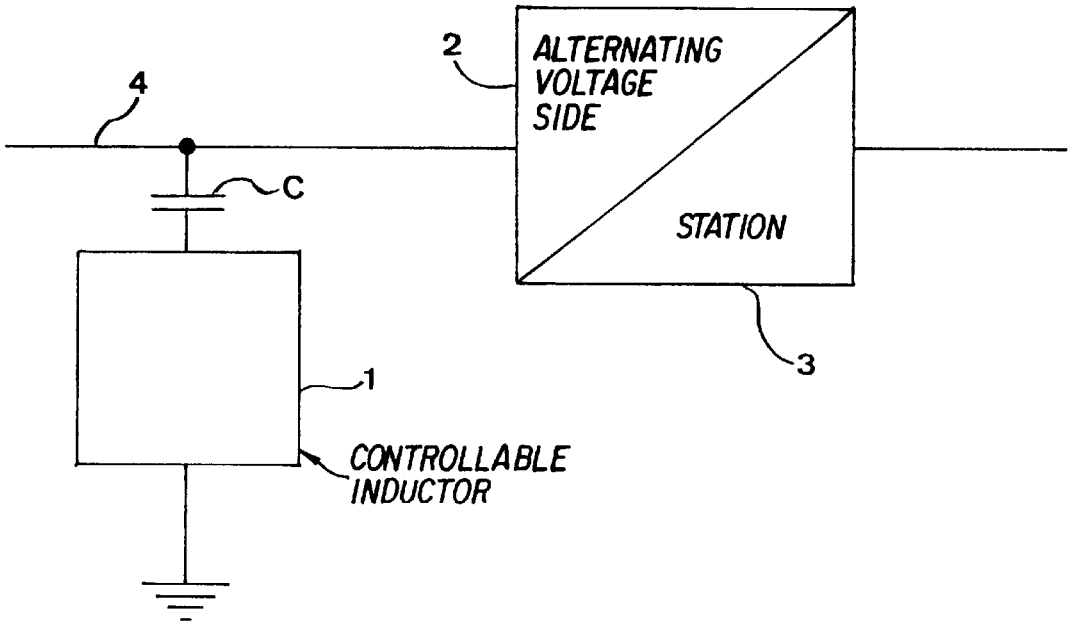
FIG. 1 shows a very schematic block scheme illustrating where the problem according to the invention may arise.

A possible field of application for an arrangement according to the invention is schematically illustrated in FIG. 1, the arrangement being formed by a controllable inductor 1, connected via a capacitor C to the alternating voltage side 2 of a station 3 for converting high voltage direct current (HVDC) to alternating current and inversely alternating current to direct current. In conjunction with such stations different currents of overtones will be generated superimposing the alternating current from the station and these overtones may disturb the other apparatuses connected to the net. The controllable inductor operates in conjunction with the capacitor as a harmonic filter and fade-out these overtones, the controllable inductor being tuned to have a minimum impedance for the specific frequency of the overtone intended to be faded out. Different loads on the net 4 at different times of the day may however cause somewhat varying frequencies of the alternating current, which makes it important that the inductance of the inductor may be controlled to all the time having the impedance minimum at the overtone frequency in question, whereby the inductor is connected to a control system for automatic adjustment of the control current of the inductor and thereby its inductance for minimising the impedance of the filter at the frequency in question.

Figure 2:
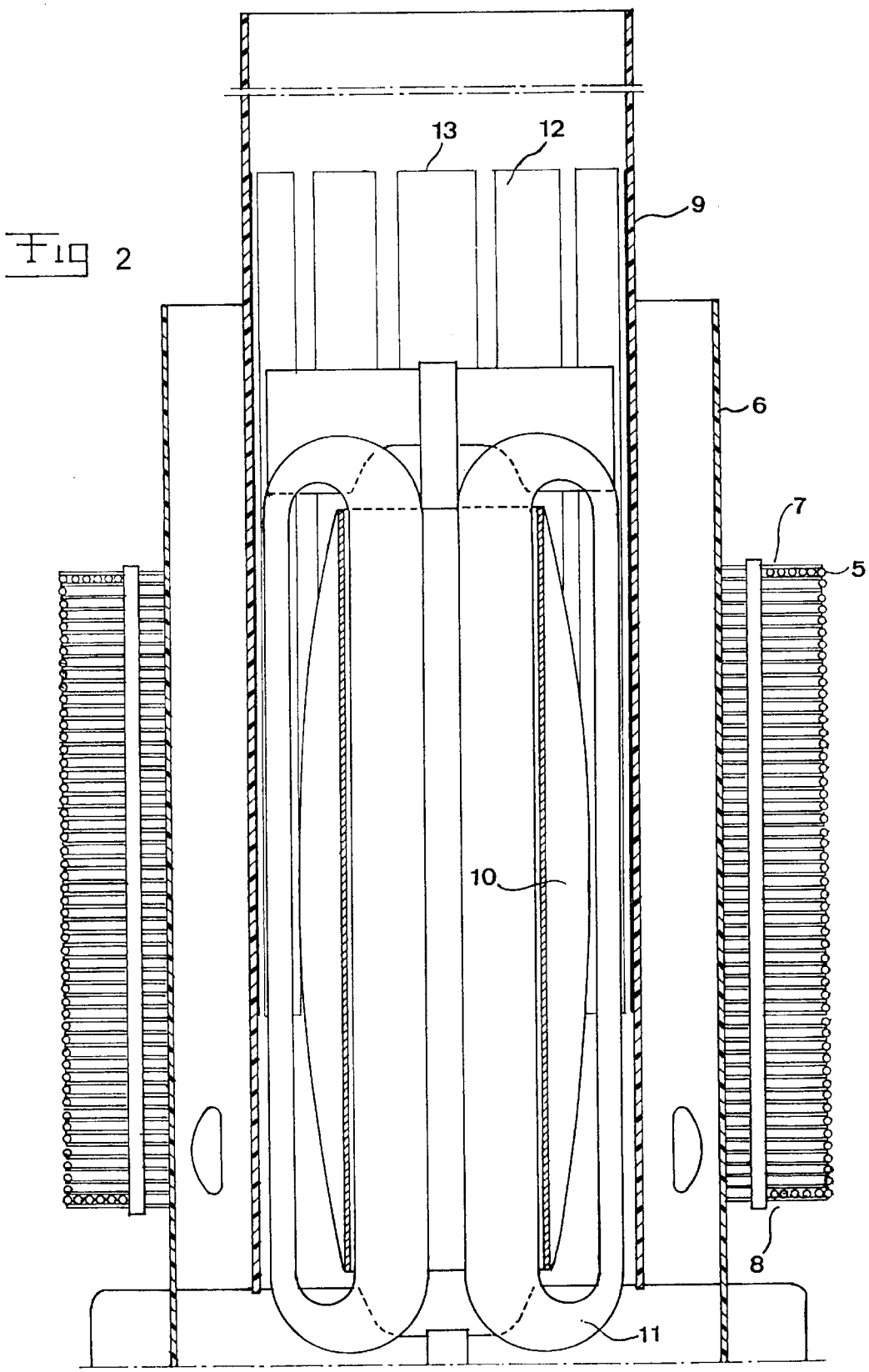
FIG. 2 is a partly cut, simplified view illustrating a controllable inductor according to a preferred embodiment of the invention.

The general construction of a controllable inductor of a preferred embodiment of the invention will now be explained with reference to FIG. 2. The inductor has a main winding 5 connected to the filter capacitor, the main winding being wound in layers at a distance outside a cylinder 6 of electrical insulating material, designated second insulating member. The main winding 5 has one end 7 on a high potential, the voltage thereby falling in direction towards the opposite end, in FIG. 2 being the lower end 8 on ground potential. A first insulating member 9 in the form of a cylinder of electrical insulating material is arranged inside and running coaxially to the second insulating member 6. A core 10 of magneticic material is arranged in the room defined by the cylinder 9 and running coaxially thereto. This core has a partly conical form at its ends, which is intended to reduce the eddy current losses therein caused by the alternating longitudinal magnetic flux generated in the core due to the alternating overtone current in the main winding 5. This phenomena is described in the applicant's WO 94/11891. A control winding 11, preferably formed by several separate part control windings, passes substantially axially through said core and returning substantially parallel to its axis in the space between the core and the first insulating member 9 in a closed loop. The control winding 11 is connectable to a direct current source, but utilizing of an alternating current is also feasible, to transmit a direct current through the same, which will generate a tangentially directed magnetic flux in the core against the longitudinal alternating flux and in that way decrease the permeability of the core for the longitudinal magnetic flux from the main winding. By increasing this direct current the permeability of the core may be decreased and thereby the inductance of the inductor will also be decreased. A lower permeability of the core will also cause a higher possible storage of energy per unit volume therein, so that the inductor may be made more compact. Because of that the power dissipation per unit volume through a magneticic flux passing across surfaces of a metal object is proportional to the square of the thickness of the object perpendicular to the flux, the core 10 has been produced by very thin sheets wound in a plurality of turns, while the control winding is constructed of a large amount of thin wires. In this way the need for cooling will be reduced and the inductor may be made more compact.

On the inside of the first cylinder 9 a part 12, is applied, said part being connected to ground and formed by elongated strips 13 of electrical conducting material with its elongation direction substantially in axial direction with respect to the core. These strips 13 are mutually connected by a strip 14 running across the other strips (see FIG. 4), said strip being arranged to electrically connect the strips 13 with each other. Contact devices are connected to ground and arranged inside the room surrounded by the first cylinder 9 and arranged to abut elastic against the strip 14 for connecting the ground part 12 with ground independent of how the first cylinder 9 is twisted at the mounting of the inductor, said contact devices are not shown. The ground part 12 is preferably formed by applying an electrically conducting colour on the inside of the cylinder 9, whereby a colour with incorporation of Cu-flakes may be utilized for this purpose. By the dividing of the ground part in thin strips the eddy current losses will be limited, which losses are due to that the longitudinal magnetic flux generated by the main winding 5 passes through the ground part with a component directed perpendicular thereto.

Figure 3:
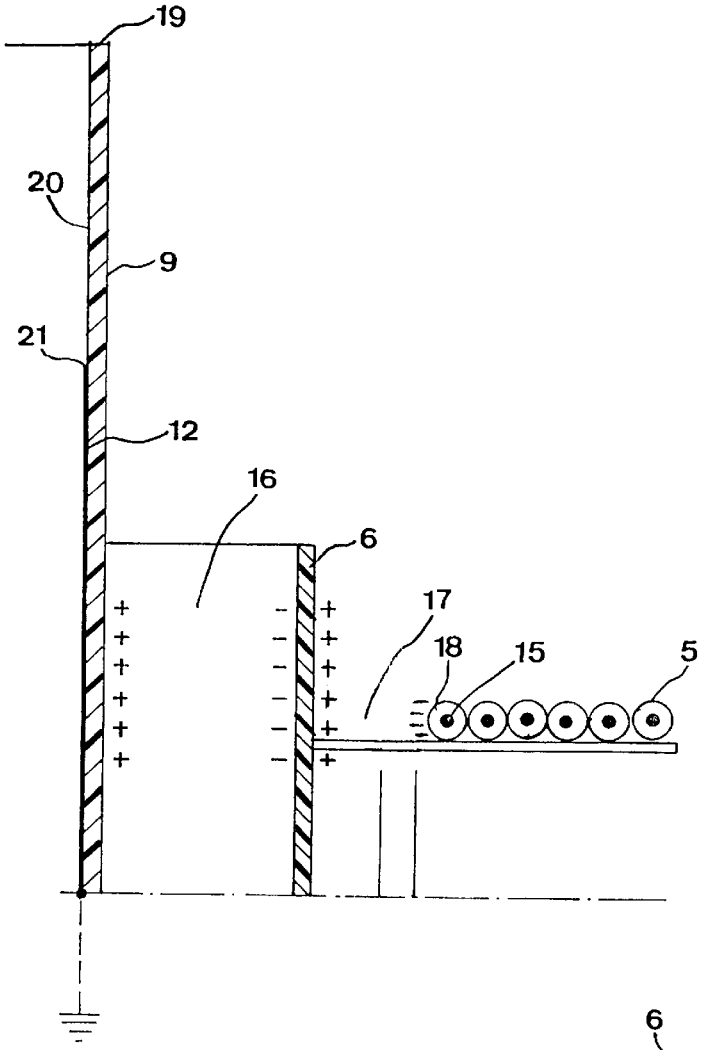
FIG. 3 is a view of a part of the inductor in FIG. 2, the view being enlarged with respect to FIG. 2, whereby the proportions are made different in order to receive more space on the drawing.

The core according to the invention will be explained below with reference to especially FIG. 3. Only the upper winding layer of the main winding 5 is shown in FIG. 3, and it is above all the inner turn of this layer that is especially exposed, as it is on a high voltage potential and closest to the ground plane. The problem that will be described below will be less accentuated the closer the main winding 5 gets to the end 8, which is the explanation to why the first cylinder 9 and the ground part 12 are not extending so far at that end as at the high voltage end 7. By normal operation of the inductor the inner conductor 15 may be on a potential of for example 75 kV, and the voltage between this conductor 15 and the ground part 12 may substantially be received by the air gaps 16, 17 separating them. however, all of a sudden a peak voltage arise, due to atmospheric disturbances or switchings in the net, the conductor 15 may for a very short time end up on a far higher voltage level, for example 450 kV. Normally, i.e. by previously known inductors, the air gap between the conductor 15 and a ground part of the inductor, which possibly could be the control winding itself, has been dimensioned so that the electrical field strength established by such peak voltage in the air gap not will get so high that there will take place any ionizing of the air and thereby causing a flash-over between the conductor 15 and the ground part, such a flash-over would be causing a perforation of the insulating envelope 18 of the conductor 15 and a short circuiting would arise from this envelope to the ground part. Thus, it is necessary to arrange the conductor 15 with a very large air gap between itself and the ground part to avoid this phenomena.

At the present inductor, at least one insulating member is however arranged between the conductor 15 and the ground part 12, in the illustrated case two insulating members are arranged, namely the insulating cylinders 9 and 6, the insulating member thus being screened off from the conductor and from the insulating cylinders. This arrangement has enabled the conductor 15 to be located closer to the ground part 12, i.e. with a less air gap between them than by previously known inductors without any requirement of increased thickness of the insulating envelope 18 of the conductor 15. The arrangement of the insulating members and the ground part according to the invention enables namely allowing such high field strength at a peak that the air molecules in the air gaps 16 and 17 will be ionized, due to that the thereby formed electrical charges may be received on surfaces of the different insulating members and outside the insulating envelope 18, whereby a voltage drop will arise through the thickness of the insulating envelope and the thicknesses of the insulating members 6 and 9. This in turn results in that the voltage drop in the air gaps 16 and 17 will be decreased and the risk of a flash-over disappears. In this way it is possible by suitable dimensioning of the insulating members to obtain a voltage drop over the air gaps in the order of 50%. It will thus be possible to arrange the main winding considerably closer to the ground part and thereby the control winding and the core than previously has been possible.

The ground part 12 ends at a considerable distance from that edge region 19 of the first insulating member 9 where the side 20 of the insulating member on which said ground part is arranged ends, which implicates a migration of charges received on the outer envelope of the cylinder 9 around said edge region 19 to the ground part. Thereby the upper end 21 of the ground part is painted with a semiconducting voltage depending colour layer, although this is not visible in the figures, to reduce the edge effect that arises with a thereby locally increased strength of the electrical field due to the plate-like capacitor function of the main winding (one of the plates) and the ground plane (the other plate). Without the equalizing of the field the electrical field strength could be so high that an emission of charges from the edge 21 of the ground part will result in a migration of charges along the surface 20, the migration thereafter being able to join the charges with inverse polarity on the surface 9.

Figure 4:
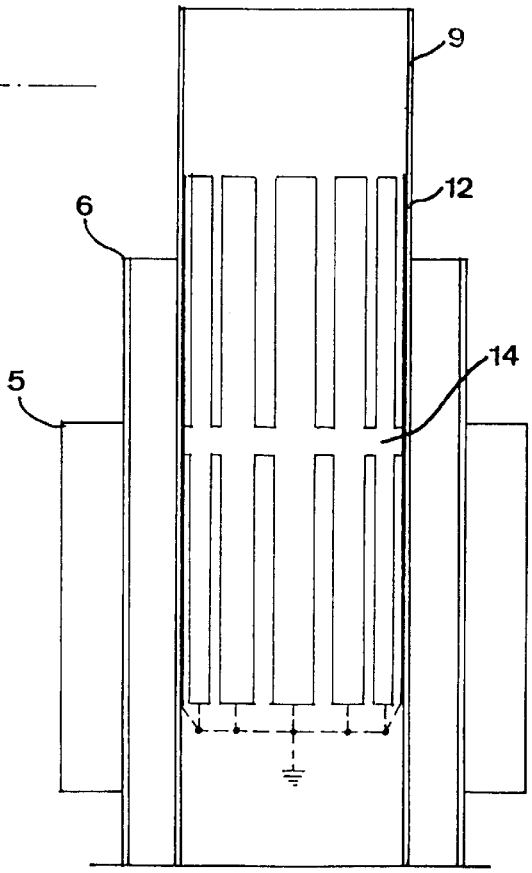
FIG. 4 is a simplified, partly cut view of the inductor according to FIG. 2 where a number of components have been eliminated for illustrating the general construction of the inductor and the proportions between different included components.

The proportions between different components of the inductor according to the invention are more visible in FIG. 4. It may be noted that the second insulating member 6 has a diameter of about 1,000 mm, that the first insulating member 9 at the high voltage end 7 is extending about 750 mm longer than the second insulating member 6 and the ground part 12 at this end ends about 450 mm from the edge region 19 of the first insulating member. Furtheron the main winding 1 at the high voltage end 7 starts at a distance of about 500 mm from the end of the second insulating cylinder 6. The thicknesses of the two cylinders 6 and 9 could be in the order of 10–15 mm, while the first air gap 16 may be about 150 mm and the second air gap 17 about 75 mm. It is important that the cylinders 6 and 9 are not too thin, while they in such case may be "punctured" at a peak.

Accordingly, the invention makes it possible to in a very advantageous way control the electrical field between a conductor being on a high voltage potential and ground.

The invention is of course not in any way limited to the above described preferred embodiment, but a number of possibilities to modifications thereof should be apparent to a man skilled in the art without departing from the scope of the invention.

For example, the different measures are defined only for exemplifying purposes and to give an indication about advantageous proportions between different parts comprised in the arrangement.

The invention also includes a controllable inductor arranged on the direct current side of the high voltage converting station.

With "high potential" all levels of voltages are comprised that are considerably higher than by the usual household net and not only real high voltage. The invention is thus also directed towards so-called intermeddyate voltage prevailing in for example the steel industry, the paper industry and in engine converter stations.

What is claimed is:

1. An arrangement comprising a conductor operable at a relatively high potential; a first member of electrically insulating material having a corresponding thickness and a selected length extending from a first end to a second end having a remote edge portion; and a ground part disposed on a support surface of the first member remote from the conductor and having a selected length including a first end connectable to ground adjacent to the first end of the first member and a second end spaced therefrom, and being separated from the conductor by a voltage receiving air gap; an insulating envelope having a corresponding thickness surrounding the conductor; the first member for screening off the ground part from the conductor, the air gap being dimensioned to withstand high electrical field strength caused by sudden strong voltage rises of the conductor such that air molecules in the air gap become ionized, and said insulating envelope having an outer surface and said first member having an opposite surface remote from the ground part, said surfaces arranged to receive electrical charges generated by said ionization for creating a voltage over their respective thicknesses and thereby decreasing the voltage drop in the air gap between the conductor and the ground part, the ground part extending along said first member so that the second end thereof is spaced from the conductor such that air is not ionized thereat, and the edge portion of the first member extending beyond the second end of the ground part for preventing electrical charges generated by the ionization and received on the surface of the first member remote from the ground part from migrating around the edge portion to reach said ground part on the support surface of said first member.

2. An arrangement according to claim 1, wherein said ground part is formed by a conducting colour applied on said first insulating member.

3. An arrangement according to claim 1, wherein said first insulating member is tubular with an inner room and said conductor is arranged at a distance radially outside thereof and running around said first insulating member.

4. An arrangement according to claim 1, wherein said first insulating member is cylindrical.

* * * * *